US012286864B2

(12) United States Patent
Jackson et al.

(10) Patent No.: US 12,286,864 B2
(45) Date of Patent: Apr. 29, 2025

(54) MULTI POSITION SINGLE DIRECTION SLEEVE, METHOD, AND SYSTEM

(71) Applicant: Baker Hughes Oilfield Operations LLC, Houston, TX (US)

(72) Inventors: Todd C. Jackson, Houston, TX (US); Maria Meredith, Cypress, TX (US); Ricardo Arturo Gomez Barker, Houston, TX (US); Matthew Solfronk, Katy, TX (US)

( * ) Notice: Subject to any disclaimer, the term of this patent is extended or adjusted under 35 U.S.C. 154(b) by 14 days.

(21) Appl. No.: 18/356,809

(22) Filed: Jul. 21, 2023

(65) Prior Publication Data

US 2024/0068327 A1 Feb. 29, 2024

Related U.S. Application Data

(60) Provisional application No. 63/400,628, filed on Aug. 24, 2022.

(51) Int. Cl.
*E21B 43/26* (2006.01)
*E21B 34/14* (2006.01)

(52) U.S. Cl.
CPC ..... *E21B 34/14* (2013.01); *E21B 43/26* (2013.01); *E21B 2200/06* (2020.05)

(58) Field of Classification Search
CPC ..... E21B 2200/06; E21B 43/26; E21B 34/14
See application file for complete search history.

(56) References Cited

U.S. PATENT DOCUMENTS

| | | | | |
|---|---|---|---|---|
| 5,318,117 | A | 6/1994 | Echols, III et al. | |
| 10,125,575 | B2 | 11/2018 | Manera et al. | |
| 2013/0233565 | A1 | 9/2013 | Turick et al. | |
| 2013/0292598 | A1 | 11/2013 | Black et al. | |
| 2014/0202706 | A1* | 7/2014 | Howell | E21B 34/102 166/374 |
| 2016/0326832 | A1* | 11/2016 | Watson | E21B 34/10 |
| 2017/0254176 | A1* | 9/2017 | van Petegem | E21B 34/14 |
| 2019/0136666 | A1* | 5/2019 | Kent | E21B 34/142 |

OTHER PUBLICATIONS

International Search Report and Written Opinion; PCT/US2023/030473; Korean Intellectual Property Office; Mailed Dec. 5, 2023; 10 pages.

* cited by examiner

*Primary Examiner* — Robert E Fuller
*Assistant Examiner* — Lamia Quaim
(74) *Attorney, Agent, or Firm* — Baker Hughes Company

(57) ABSTRACT

A multi position single direction sleeve valve includes a housing having a port therein, and a sleeve movable within the housing, the sleeve having a first portion including a radially extending opening therein and a second portion, the second portion being releasably attached to the first portion. A fracture system, including multi position single direction sleeve valve, and a bottom hole assembly having a profile engagable with the sleeve to shift a position of the sleeve relative to the housing, the bottom hole assembly having a debris barrier. A method including running the multi position single direction sleeve, including moving the sleeve from a closed position to an open position, and moving the sleeve from the open position to a closed position.

14 Claims, 5 Drawing Sheets

MULTI POSITION SINGLE DIRECTION SLEEVE, METHOD, AND SYSTEM

CROSS REFERENCE TO RELATED APPLICATION

This application claims the benefit of an earlier filing date from U.S. Provisional Application Ser. No. 63/400,628 filed Aug. 24, 2022, the entire disclosure of which is incorporated herein by reference.

BACKGROUND

In the resource recovery and fluid sequestration industries sliding sleeves are well known. They are used for many types of operations. In general, sliding sleeves are moved in one direction to open and the opposite direction to close. This can be effective in some situations. The art is always receptive to alternatives that provide utility in various applications.

SUMMARY

An embodiment of a multi position single direction sleeve valve, including a housing having a port therein extending radially through a wall of the housing, and a sleeve movably disposed within the housing, the sleeve having a first portion including a radially extending opening therein and a second portion, the second portion being releasably attached to the first portion.

An embodiment of a fracture system, including a housing having a port therein extending radially through a wall of the housing, a sleeve movably disposed within the housing, the sleeve having a first portion including a radially extending opening therein and a second portion, the second portion being releasably attached to the first portion, and a bottom hole assembly having a profile engagable with the sleeve to shift a position of the sleeve relative to the housing, the bottom hole assembly having a debris barrier.

An embodiment of a method for fracturing a formation including running the multi position single direction sleeve valve, engaging the sleeve with a bottom hole assembly, pulling in a first pull on the sleeve in an uphole direction, moving the sleeve from a closed position to an open position, pulling in a second pull on the sleeve in an uphole direction, and moving the sleeve from the open position to a closed position.

An embodiment of a multi position sleeve valve including a housing, and a sleeve, the sleeve configured to be opened from a first closed position and closed to a second closed position from the opened position by moving relative to the housing in a single direction.

An embodiment of a borehole system including a borehole in a subsurface formation a string in the borehole, and a valve disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
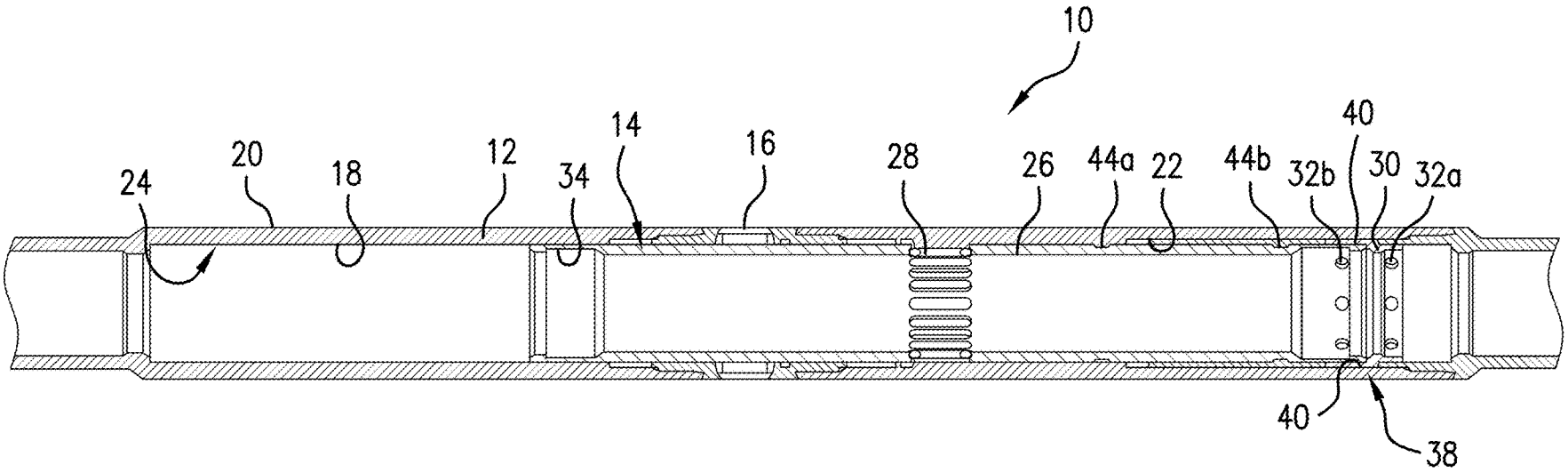
FIG. 1 is a sectional view of a multi position sleeve valve as disclosed herein in a first closed position.
Figure 2:
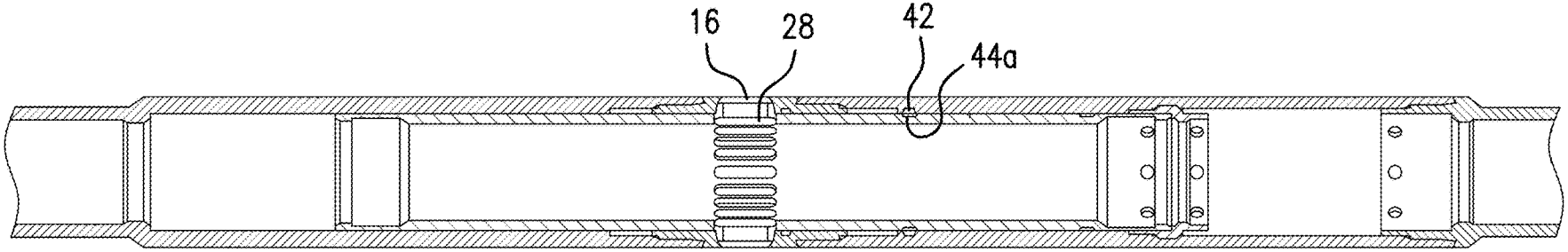
FIG. 2 is a sectional view of the multi position sleeve valve of FIG. 1 in a first open position.
Figure 3:
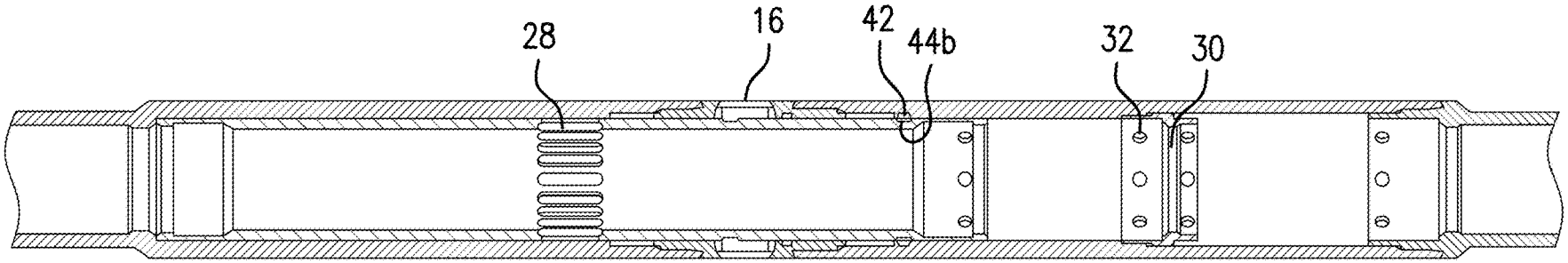
FIG. 3 is a sectional view of the multi position sleeve valve of FIG. 1 in a second closed position.

Referring to FIGS. 1-3, a multi position sleeve valve 10 is illustrated. The valve 10 comprises a housing 12 and a sleeve 14 disposed therein. The housing 12 includes a port 16 extending from an inside diameter surface 18 to an outside diameter surface 20. In embodiments, ports 16 are located circumferentially about the housing 12. The housing 12 further comprises a shoulder 22, the purpose of which will become evident hereunder, and defines a sleeve movement area 24 that is sufficient in length to facilitate sleeve 14 movement from a housing port closed position (FIG. 1) to a housing port open position (FIG. 2) to a housing port closed position (FIG. 3) in a single direction.

Figure 4:
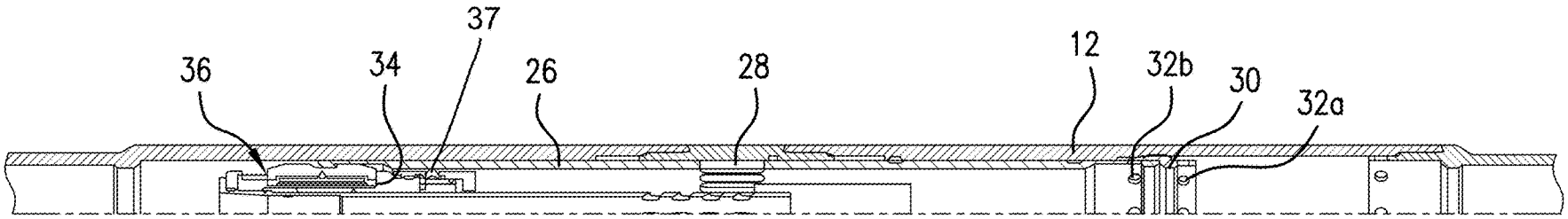
FIG. 4 is a sectional view of the multi position sleeve valve of FIG. 1 with a bottom hole assembly with debris barrier engaged therewith.

The sleeve 14 comprises a first portion 26 including a radially extending opening 28 therein and a second portion 30, the second portion 30 being releasably attached to the first portion 26 and releasably attached to the housing 12. The releasable attachment to the housing 12 comprises a releaser 32*a* and the releasable attachment to the first portion 26 comprises a releaser 32*b* each of which may in an embodiment be a shear screw or screws. The first portion 26 includes an inside diameter profile 34 to support engagement with a bottom hole assembly (BHA) 36 with debris barrier 37 (See FIG. 4) that shifts the sleeve 14, when desired. The second portion 30 presents, on an outer surface 38 thereof, a profile 40. Profile 40 is configured to abut shoulder 22 when the valve 10 is in the position illustrated in FIG. 2. This position is reached at the beginning of a fracturing operation when the BHA 36 is used to move the sleeve 14 from the run-in closed position of FIG. 1 to the open position of FIG. 2. The shoulder will give a positive stop feedback to operators so that the uphole direction pull on the BHA 36 may be paused to allow for the fracturing operation to take place through the aligned opening 28 and port 16. In embodiments, there is also a snap ring 42 disposed in the housing 12 that snaps into grooves 44*a* and 44*b* in the sleeve 14 depending upon which position the sleeve 14 is in. One particular benefit of the valve disclosed herein is its tolerance to underdisplaced proppant in a fracturing operation. Underdisplacement, means that some of the proppant still remains in the port 16 rather than having been displaced completely out into the formation. The remaining proppant in/near the port 16 tends to cause frictional jamming of sleeves of the prior art. Sleeves of any kind of valve must be closed after the fracture operation to prepare the completion for production. The valve 10 does not suffer this indignity. This is in part due to the single direction actuation of the valve 10 from closed to open to closed again. All of the movement of the sleeve 14 is in a single direction, which may be uphole in an embodiment.

Once the fracturing operation is completed, the sleeve 14 is subjected to overpull from the BHA 36. The tensile force imparted to the sleeve 14 is initially reacted through the profile 40 against shoulder 22 but when the force grows to above a threshold force required to release releaser 32*b*, the releaser 32*b* releases the second portion 30 from the first portion 26. Upon release, the first portion 26 is drawn uphole and closes the ports 16 by misaligning the opening 28 with port 16. The second portion 30, however, stays in place, engaged with shoulder 22.

Figure 5:
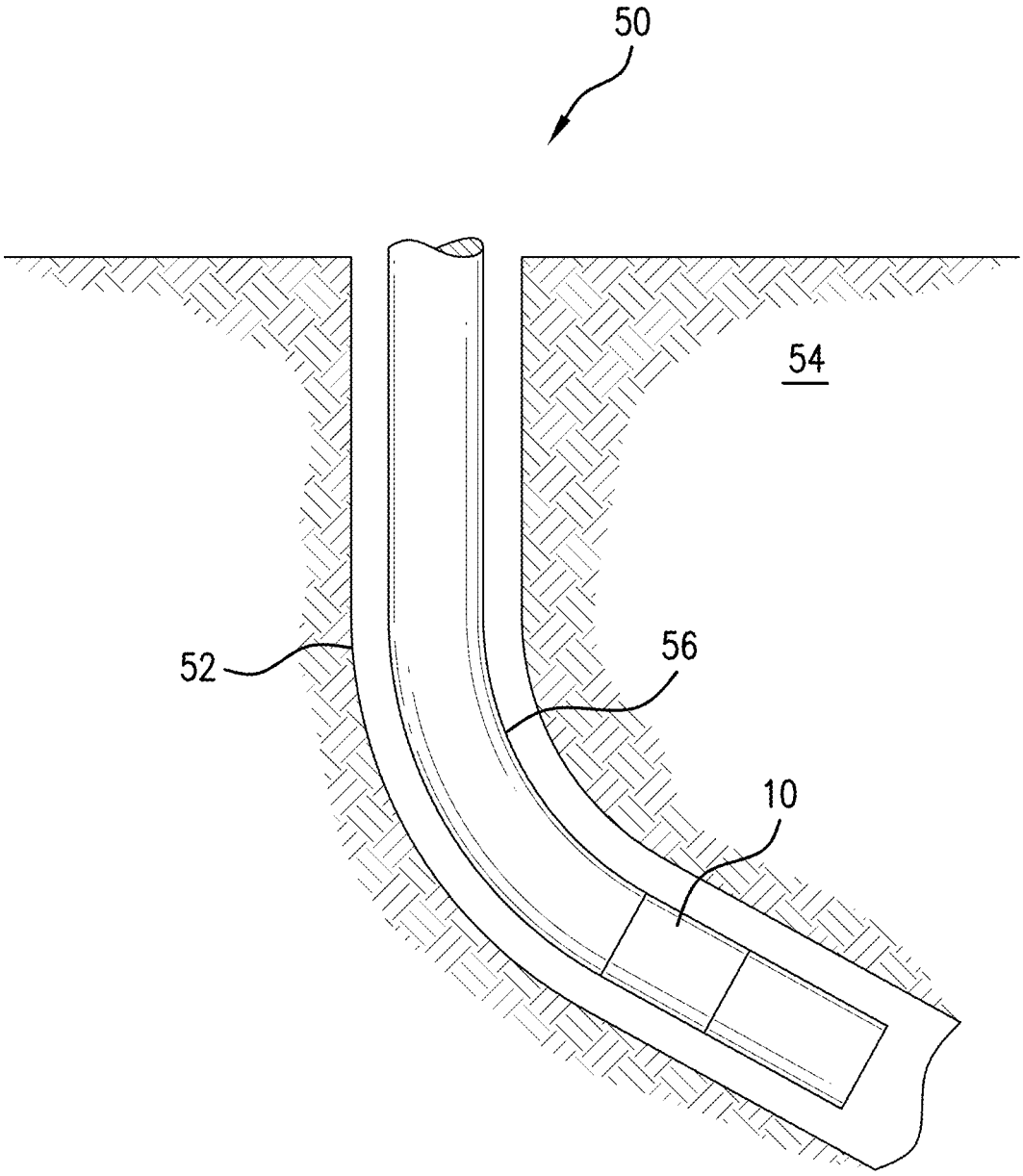
FIG. 5 is a view of a borehole system including the multi position sleeve valve as disclosed herein.

Referring to FIG. 5, a borehole system 50 is illustrated. The system 50 comprises a borehole 52 in a subsurface formation 54. A string 56 is disposed within the borehole 52. A valve 10 as disclosed herein is disposed within or as a part of the string 56.

In use, the valve 10 is run into the borehole 52 to a target location with the sleeve 14 in a first closed position. When fracturing is desired, the BHA 36 is moved into engagement with the profile 34 and the sleeve 14 is pulled in an uphole direction to release releaser 32*a*, align the opening 28 and port 16, and engage the profile 40 of the second portion 30 with the shoulder 22 of the housing 12. This is the opened position. In this position proppant may be forcibly expelled through the port 16 into a surrounding formation 46. Before full displacement is achieved, the fracturing operation is halted, leaving proppant in the formation 46, in an annulus 48 and the port 16. The sleeve 14 is then subjected to overpull from an uphole, location, like a surface location, through the BHA 36 until the releaser 32*b* releases. Once release is achieved, the first portion 26 is moved uphole to misalign the opening 28 and the port 16 to close the port 16 and prepare the valve for later production. This is the second closed position. The snap ring 42 will snap into groove 44*b* when the sleeve 14 is drawn fully uphole to retain the sleeve 14 in the closed position against unintended movement, until later opened for production. The sleeve 14 is configured to cycle between the opened position and the second closed position with reciprocal movement relative to the housing by using the profile 34.

Set forth below are some embodiments of the foregoing disclosure:

Embodiment 1: A multi position single direction sleeve valve, including a housing having a port therein extending radially through a wall of the housing, and a sleeve movably disposed within the housing, the sleeve having a first portion including a radially extending opening therein and a second portion, the second portion being releasably attached to the first portion.

Embodiment 2: The valve as in any prior embodiment, wherein the housing includes a shoulder and the second portion includes a profile engagable with the shoulder.

Embodiment 3: The valve as in any prior embodiment, wherein the second portion is attached to the first portion with an overpull sensitive releaser.

Embodiment 4: The valve as in any prior embodiment, wherein the releaser is a shear fastener.

Embodiment 5: The valve as in any prior embodiment, further including a locating ring disposed in the housing and extending into a groove of the sleeve when the sleeve is positioned in a preselected location.

Embodiment 6: The valve as in any prior embodiment, wherein the housing defines a sleeve movement area that is sufficient in length to facilitate sleeve movement from a housing port closed position to a housing port open position to a housing port closed position in a single direction.

Embodiment 7: The valve as in any prior embodiment, wherein the single direction is an uphole direction.

Embodiment 8: A fracture system, including a housing having a port therein extending radially through a wall of the housing, a sleeve movably disposed within the housing, the sleeve having a first portion including a radially extending opening therein and a second portion, the second portion being releasably attached to the first portion, and a bottom hole assembly having a profile engagable with the sleeve to shift a position of the sleeve relative to the housing, the bottom hole assembly having a debris barrier.

Embodiment 9: The system as in any prior embodiment, wherein the debris barrier is axially shortened to radially expand, when deployed for use.

Embodiment 10: A method for fracturing a formation including running the multi position single direction sleeve valve as in any prior embodiment, engaging the sleeve with a bottom hole assembly, pulling in a first pull on the sleeve in an uphole direction, moving the sleeve from a closed position to an open position, pulling in a second pull on the sleeve in an uphole direction, and moving the sleeve from the open position to a closed position.

Embodiment 11: The method as in any prior embodiment, wherein the first pull seats a profile of the sleeve on a shoulder of the housing.

Embodiment 12: The method as in any prior embodiment, further including releasing a releaser attaching the second portion to the first portion by the second pull.

Embodiment 13: The method as in any prior embodiment, wherein the releasing is shearing.

Embodiment 14: A multi position sleeve valve including a housing, and a sleeve, the sleeve configured to be opened from a first closed position and closed to a second closed position from the opened position by moving relative to the housing in a single direction.

Embodiment 15: The valve as in any prior embodiment, wherein the sleeve is configured to cycle between the opened position and the second closed position with reciprocal movement relative to the housing.

Embodiment 16: A borehole system including a borehole in a subsurface formation a string in the borehole, and a valve as in any prior embodiment, disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A multi position single direction sleeve valve, comprising:

a housing having a port therein extending radially through a wall of the housing; and a sleeve movably disposed within the housing, the sleeve having a first portion including a radially extending opening therein and a second portion, the second portion being releasably attached to the first portion, the sleeve during use, moving from a first housing port closed position to a housing port open position a second housing port closed position in a single direction.

2. The valve as claimed in claim 1, wherein the housing includes a shoulder and the second portion includes a profile engagable with the shoulder.

3. The valve as claimed in claim 1, wherein the second portion is attached to the first portion with an overpull sensitive releaser.

4. The valve as claimed in claim 3, wherein the releaser is a shear fastener.

5. The valve as claimed in claim 1, further including a locating ring disposed in the housing and extending into a groove of the sleeve when the sleeve is positioned in a preselected location.

6. The valve as claimed in claim 1, wherein the housing defines a sleeve movement area that is sufficient in length to facilitate the sleeve movement in the single direction.

7. The valve as claimed in claim 1, wherein the single direction is an uphole direction.

8. A fracture system, comprising:

a housing having a port therein extending radially through a wall of the housing;

a sleeve movably disposed within the housing, the sleeve having a first portion including a radially extending opening therein and a second portion, the second portion being releasably attached to the first portion, the sleeve, during use, moving from a first housing port closed position to a housing port open position to a second housing port closed position in a single direction; and a bottom hole assembly having a profile engagable with the sleeve to shift a position of the sleeve relative to the housing, the bottom hole assembly having a debris barrier.

9. The system as claimed in claim 8, wherein the debris barrier is axially shortened to radially expand, when deployed for use.

10. A method for fracturing a formation comprising:

running the multi position single direction sleeve valve as claimed in claim 1;

engaging the sleeve with a bottom hole assembly;

pulling in a first pull on the sleeve in an uphole direction;

moving the sleeve from a closed position to an open position;

pulling in a second pull on the sleeve in an uphole direction; and moving the sleeve from the open position to a closed position.

11. The method as claimed in claim 10, wherein the first pull seats a profile of the sleeve on a shoulder of the housing.

12. The method as claimed in claim 11, further including releasing a releaser attaching the second portion to the first portion by the second pull.

13. The method as claimed in claim 12, wherein the releasing is shearing.

14. A borehole system comprising:

a borehole in a subsurface formation;

a string in the borehole; and a valve as claimed in claim 1 disposed within or as a part of the string.

* * * * *